US005497722A

United States Patent [19]

English, Sr.

[11] Patent Number: 5,497,722

[45] Date of Patent: Mar. 12, 1996

[54] KEELLESS CONCAVE HULL

[76] Inventor: Charles English, Sr., 1507 Heritage Landing Dr., Chattanooga, Tenn. 37405

[21] Appl. No.: 301,580

[22] Filed: Sep. 7, 1994

[51] Int. Cl.[6] ..... B63B 1/00

[52] U.S. Cl. ..... 114/62; 114/271; 114/288

[58] Field of Search ..... 114/56, 61, 271, 114/62, 283, 288

[56] References Cited

U.S. PATENT DOCUMENTS

| | | | |
|---|---|---|---|
| Re. 25,816 | 7/1965 | Bamberger . | |
| D. 184,844 | 4/1959 | Woolever . | |
| 304,426 | 9/1884 | Hart . | |
| 804,269 | 11/1905 | Ross . | |
| 815,187 | 3/1906 | Manker . | |
| 928,579 | 7/1909 | Apel . | |
| 1,815,303 | 7/1931 | Kloen | 114/62 |
| 1,886,507 | 11/1932 | Wehr . | |
| 2,336,987 | 12/1943 | Garber et al. . | |
| 2,366,590 | 1/1945 | Brownback . | |
| 2,450,665 | 10/1948 | Jutte . | |
| 2,735,392 | 2/1956 | Cox . | |
| 3,709,179 | 1/1973 | Payne . | |
| 3,800,725 | 4/1974 | L'Heureux . | |
| 3,884,171 | 5/1975 | Kline | 114/62 |
| 4,192,248 | 3/1980 | Moyer . | |

FOREIGN PATENT DOCUMENTS

| | | | |
|---|---|---|---|
| 583824 | 10/1958 | France | 114/288 |
| 2093 | of 1899 | United Kingdom | 114/61 |

*Primary Examiner*—Jesus D. Sotelo

*Attorney, Agent, or Firm*—Popham, Haik, Schnobrich & Kaufman, Ltd.

[57] ABSTRACT

A boat hull constructed with an inverted U-shaped hull bottom, hull sides which are vertical below the at-rest water line and outwardly curved in a deep arc above the at-rest water line, and a rudderless, arcuate concave tunnel from bow to stern is disclosed. Preferably, the port and starboard gunwales are parallel and the port and starboard chines are parallel. The inventive boat hull is capable of smoothly and rapidly assuming a hydroplaning position without use of submerged hydrofoils, and without pounding upon waves. The hull is navigable in fouled water, substantially reduces water sprayed aboard, and eliminates "tripping" when navigated through sharp turns.

6 Claims, 5 Drawing Sheets

KEELLESS CONCAVE HULL

FIELD OF THE INVENTION

The present invention generally relates to improvements in the design of power boats for both pleasure and commercial use. The present invention specifically relates to power boats having keelless hulls provided with an inverted "U"-shaped hull bottom to permit hydroplaning with reduced friction and improved stability and economy.

BACKGROUND OF THE INVENTION

Operation of high-speed passenger boats in rough water presents many engineering challenges. When boats having conventional U-shaped or V-shaped hulls are operated at high speed over large waves, many problems are encountered, including severe pounding of the hull bottom on the waves, spraying of large amounts of water over the bow and onto the deck, and instability negotiating sharp turns.

In an attempt to eliminate these problems, prior inventors have devised various types of hydroplaning boats having hulls which ride above the water surface, reducing surface friction and spray. Most hydroplanes employ submerged hydrofoils or full length tunnels or other devices to lift the hull out of the water.

However, such prior art boats retain significant disadvantages which render such boats unsuitable for large-scale commercial passenger and freight use. In particular, prior art boats typically operate with very low planing weight. To achieve hydroplaning, prior art boats employ expensive, lightweight, fragile hulls unsuitable for carrying commercial cargo or passengers. Such boats are usually capable of efficiently carrying, at maximum, 45 pounds per engine horsepower, including the weight of hull, engine, and crew.

Prior art hydroplaning hulls also cause severe surface-hull pounding, even in moderately rough water, which pounding is uncomfortable and in many cases dangerous.

Under certain conditions prior art boats, having U-shaped or V-shaped hulls constructed with forward water lines (or lines of immersion) curving inward toward a vertical stem or keel line, are highly susceptible to "tripping." Also, waves are generated by V-shaped hulls; the deeper the V, the heavier the wave. Tripping is a dangerous condition encountered when a boat is turned sharply in one direction; the boat slides laterally over the water surface in a direction opposite the direction of the turn, creating a high risk of capsizing.

Finally, prior art boat designs with inward curving forward water lines typically have continuously wet hulls during operation, and throw water onto the deck at low or moderate speeds, and in some cases, even at high speeds.

The present invention resolves the above problems by providing a keelless inverted "U" boat hull having upright, nearly vertical sides from the chines to the at-rest water line, deeply, outwardly-curved hull sides from the at-rest water line to the gunwales, and propulsion means (surface piercing out-drives, stern drives, outboard motors, or water jets) operative to guide the boat without a rudder, or bottom appendages thereby lessening drag and promoting stability during sharp turns. The curved dead rise sides of the tunnel from the chines to the tunnel apex generate a wake and spray that is captured in the tunnel. The air, solid wake water and spray proceed aft toward the stern, hydrodynamically elevating the hull in a lateral fashion fore and aft.

Prior inventors have addressed similar problems, but without including all the features of the present invention. For example, several prior art patents disclose boat hulls having inverted, concave surfaces, but these hulls generally include keels or rudders. For example, U.S. Pat. Nos. 804,269 (Ross), 815,187 (Manker), and 4,192,248 (Moyer) show boat hulls having inverted-U, concave bottom surfaces, but all these prior patents include keels or rudders. Further, U.S. Pat. No. 2,735,392 (Cox) shows a boat hull having an upwardly arched bottom and a plurality of keels provided with rudders and propellers. These prior art references do not permit rapid, smooth hydroplaning and exclude other features of the present invention.

Other prior inventions provide submerged planing surfaces, causing substantial surface friction which is circumvented by a boat hull according to the present invention. For example, U.S. Pat. No. 3,709,179 (Payne) includes submerged planing surfaces 22 interposed between the inner chine and the outer chine.

U.S. Pat. No. 2,366,590 (Brownback) shows a speed boat having an inverted-U forward hull portion and an aft hull portion including chine line 1B and keel 1D. The inverted U-hull of Brownback terminates at a point midway between the bow and stern such that a flat portion of the hull bottom and the keel, remain submerged and do not hydroplane.

Similarly, U.S. Pat. No. 1,886,507 (Wehr) shows a boat hull having an inverted concave hull and flat sides 11 and 12. These sides do not effectively prevent tripping. Further, Wehr shows keels 16 and 17, and chine lines 18 and 19, which create submerged planing surfaces. These surfaces cause significant friction between the hull and the water surface.

Thus, the prior art is deficient and does not provide a hydroplaning boat hull having all the features of the present invention. Specifically, the prior art does not include a boat hull constructed with an inverted U-shaped hull bottom tunnel, flared hull sides which are outwardly curved at a deep arc, and rudderless construction. Further, no prior art references disclose a boat hull having the aforementioned structure which is capable of smoothly and rapidly assuming a hydroplaning position without squatting at stern during acceleration, or use of hydrofoils, which reduces wave pounding, which is navigable in fouled water, which substantially reduces wake or water sprayed aboard, and which avoids "tripping" when navigated through sharp turns. Consequently, commercial freight and passenger boat operators, as well as pleasure boat enthusiasts, would find useful a boat hull according to the present invention which avoids all the aforementioned disadvantages of the prior art.

SUMMARY OF THE INVENTION

Accordingly, it is one object of the present invention to furnish new means to stabilize and improve the seaworthiness of boats operating at high speed, either in rough or smooth water, by providing a low center of gravity and low center of buoyancy in a hull having an inverted U-shaped hull bottom.

A further object of the present invention is to provide a boat hull design which, upon acceleration, will quickly and smoothly hydrodynamically rise to a hydroplaning position, and which simultaneously permits the boat to glide upon a cushion of air and water and the surface of the water supporting greater weight per horsepower than prior art boats, and at greater speed per horsepower per pound than prior art boats, due to less percentage of hull being submerged in the water, reducing the drag and friction resistance on the hull.

Still a further object of the present invention is to eliminate pounding of the hull bottom on rough water, due to the cushioning on the mass of captured water and air in the tunnel.

Yet a further object of the present invention is to permit smooth navigation through water fouled with weed growth and driftwood, due to the hull's shallow draft.

Still another object of the present invention is to reduce the wake and water spray encountered during operation in rough water and in wind, regardless of the speed at which the boat may be driven, due to the lack of any dead rise outboard of the chines.

These objects, and other objects which will become apparent from the following description, are achieved by providing a boat hull having the following main characteristics:

1. Upright, absolutely vertical sides from the chines to the water line with no dead rise extended forward at practically their full height from stern to bow, and a flare outwards to the deck such that the hull bow is as wide as the stern.
2. A hull bottom having an inverted "U" or arcuate concave tunnel section profile; the top of the hull bottom is higher than the angles of the bilge, and the depth of the inverted "U" section decreases in curvature depth toward the stern to a nearly flat curve.
3. Tunnel sides provided with water lines or lines of immersion which curve outwardly at the chines in a relatively deep arc. The hull sides are constructed having no dead vertical rise above the chines to the average water line. The water lines curve outwardly in the tunnel regardless of the angle at which the boat may be inclined in relation to the surface of the water.

These features are incorporated in a boat hull according to the present invention suited to the requirements of high-speed boats. The present invention may be used, with equal success, for pleasure boats, cruisers, or passenger carrying boats of any size. The above three characteristics operate in the following way to eliminate the disadvantages discussed above.

The inverted "U" bottom sections of a boat hull according to the present invention provide a tunnel-like watercourse with no appendages. This tunnel prevents the hull from throwing spray water over the deck, due to the vertical area from the chines to the water line and lack of dead rise. Instead, the spray-water and air scooped in at the bow are smoothly carried under the boat to the stern, and the spray and air exit the boat hull aft of the stern. Essentially, the boat hydroplanes over a compressed air and spray layer generated inside the inverted "U" hull, without spray or wake outboard of the vertical portion of the hull sides. The layer of spray and air provides a fluid cushion layer to rapidly elevate the boat hydrodynamically, thus enabling the hull to assume a planing position more quickly than prior art hydroplanes.

These hull characteristics permit creation of a hydroplaning boat without hydrofoils, and permit constructing a heavier hull and employing a heavier engine, while simultaneously permitting planing capacity sufficient to carry passengers or cargo. Accordingly, a boat employing a hull according to the present invention will support weights of 75 pounds or more per horsepower, a substantial advance over the prior art.

A hull according to the present invention also practically eliminates pounding. The water spray and air cushion which is carried under the boat by the novel form of the hull's design, as discussed above, dampens waves encountered by the boat and. provides a smooth surface for travel. Consequently, pounding is drastically reduced. Elimination of pounding through the present invention not only reduces the risk of injury to the structure of the boat or the engines, but eliminates constant strain and stress felt by the passengers travelling in prior art boats in rough waters.

Next, in a boat hull according to the present invention, use of water lines and hull sides which are vertical below the water line and deeply curved outwardly to the deck from the water line, eliminates tripping and the creation of wake. Instead of planing in a direction opposite the direction to which the boat is inclined in a sharp turn, the present hull planes toward the turn direction to which the boat is inclined. This feature automatically stabilizes the entire boat, reducing the risk of capsizing. Further, this feature enables boats employing the present inverted "U" tunnel hull to travel on an even keel attitude when operated in any direction, even in comparatively rough water.

Finally, a boat having a hull according to the present invention is drier, and throws less water outboard and aboard at all speeds and in all conditions of water than prior art boats do. Since the present boat hull has top sides which do not curve inwardly at the bow, there is no "bluff of the bow" to raise water above the deck line. Further, the outwardly-curving hull sides reduce and practically eliminate the amount of spray thrown sideways, which in prior art constructions could easily be blown aboard by a "beam wind" blowing laterally across the boat.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF PREFERRED EMBODIMENTS

Figure 1:
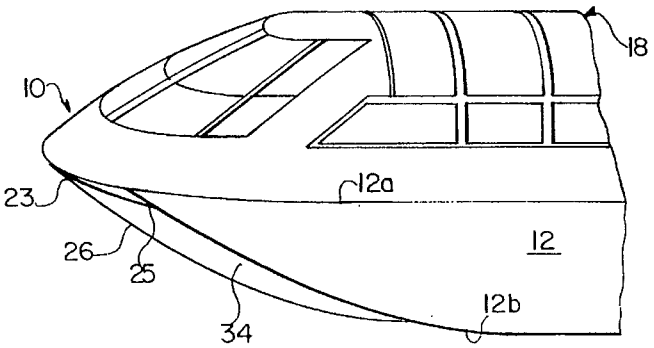
FIG. 1 is a partial perspective view of the bow of a boat hull according to the present invention, showing the structure of the bow and the keelless bottom.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring generally to FIGS. 1 through 9, a preferred embodiment of a boat hull according to the present invention is shown and is generally designated by reference numeral 10. As shown in section views FIGS. 7 and 8, the hull 10 is constructed with substantially concave, deeply outwardly curved hull sides 12 and 14 having substantially parallel top edges or gunwales 12*a* and 14*a*, respectively, and substantially parallel chines 12*b* and 14*b*, respectively. An at-rest water line WL demarcates that portion of hull sides 12 and 14 which remain above water when the hull 10 is at rest. Hull 10 has a bow end 11 and a stern end 13. The sides 12 and 14 are mirror images of one another, and are joined at the bow end 11 of the hull 10 by an arcuate transverse stem 23.

Figure 2:
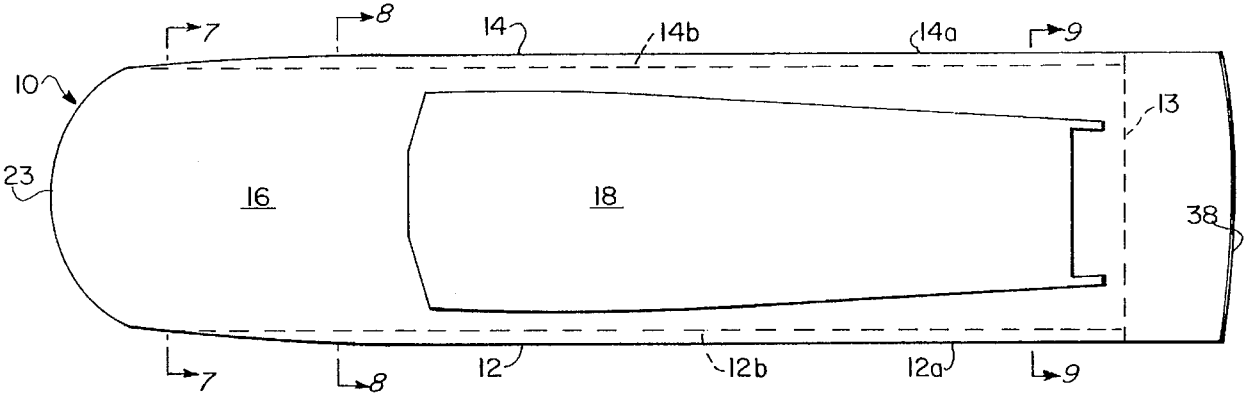
FIG. 2 is a top plan view of a boat hull according to the present invention.

As shown in FIG. 1, at the bow end 11 of the hull 10, the stem 23 connects the hull sides 12 and 14 along a nearly horizontal plane. For aesthetic reasons, and to reduce wind resistance or drag, the stem 23 is formed having an arcuate convex shape when viewed from above, as shown in FIG. 2. Further, aft of the stem 23, the hull deck 16 is preferably constructed with a slightly upwardly arcuate or arched profile, as shown in FIG. 7.

The horizontal stem 23 construction is different from prior art boat hulls which generally incorporate a vertical stem terminating in a keel running along the bottom of the boat and terminating at the stern.

Figure 7:
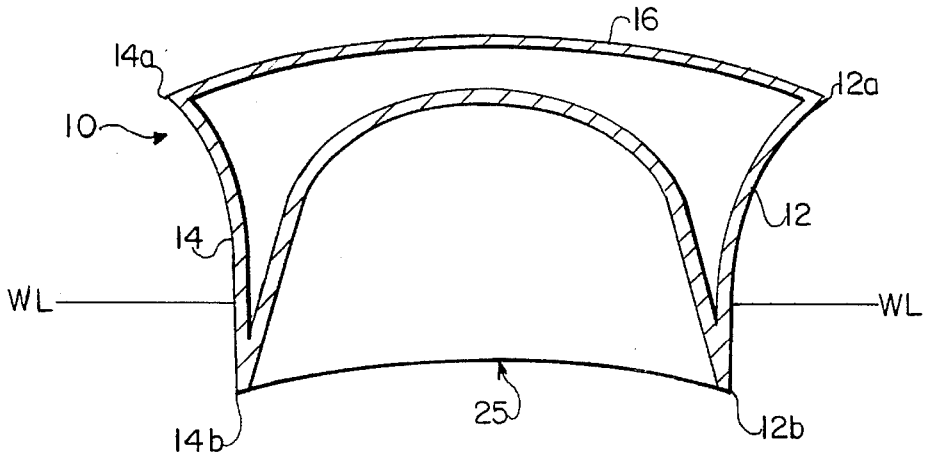
FIG. 7 is a section elevation view taken at line 7—7 of FIG. 2.

As particularly shown in FIG. 7, a boat hull according to the present invention lacks a conventional keel. Instead, sides 12 and 14 are outwardly flared above the at-rest water line WL to the gunwales or upper edges 12*a* and 14*a*, and are vertical below the at-rest water line WL to the chines 12*b* and 14*b*. Hull sides 12 and 14 do not create a wake and include no dead vertical rise above the water line WL.

In one embodiment of the present invention, the deck beam distance measured along a level horizontal plane between upper edges 12*a* and 14*a* is 16 feet, and is one foot more than the chine beam distance measured along a level horizontal plane connecting chines 12*b* and 14*b*. In other embodiments, the difference between the deck beam distance and the chine beam distance may be increased, thus increasing the amount of flaring of sides 12 and 14. However, reducing the chine beam distance too much, without also reducing the deck beam distance, causes increased instability during navigation.

Figure 8:
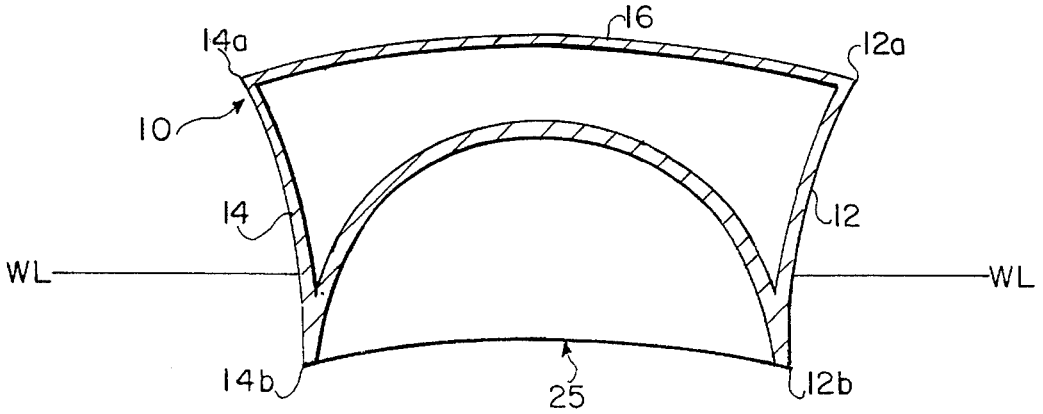
FIG. 8 is a section elevation view taken at line 8—8 of FIG. 2.

In FIGS. 7 and 8, flared hull sides 12 and 14 are shown constructed using an elliptical curve to define the flared, outwardly curved portions of sides 12 and 14. In an alternative embodiment, hull sides 12 and 14 may be constructed using flat hull side portions angularly joined at a point just above the water line. In such an embodiment, the difference between the chine beam distance and the deck beam distance is still preferably one foot, but flat hull sides secured at an obtuse angle are used rather than curved hull sides.

A hull according to the present invention is suited to construction using a variety of deck beam distances, and the overall length of the hull may be between seventeen (17) feet and over ninety (90) feet. In a hull having an overall length of ninety (90) feet, the deck beam is typically thirty-five (35) feet.

Figure 9:
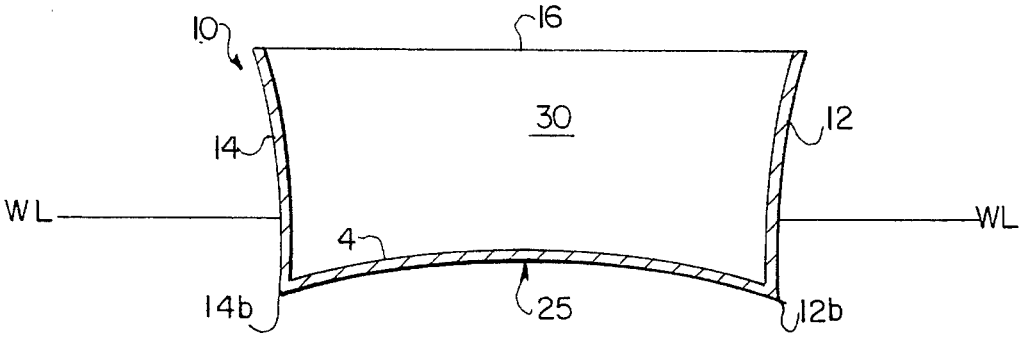
FIG. 9 is a section elevation view on the line 9—9 of FIG. 2.

In the preferred embodiment of FIGS. 1 through 13, the hull side edges 12' and 14' are connected with a relatively flat but slightly arched deck 16. As shown in FIG. 7 and 8, the deck 16 is slightly convex at the bow of the boat and tapers to a flat surface at the stern of the boat as shown in FIG. 9. In alternative embodiments, an entirely flat deck may be employed. A conventional cabin 18 may be constructed atop the deck 16 according to any desired configuration.

Figure 3:
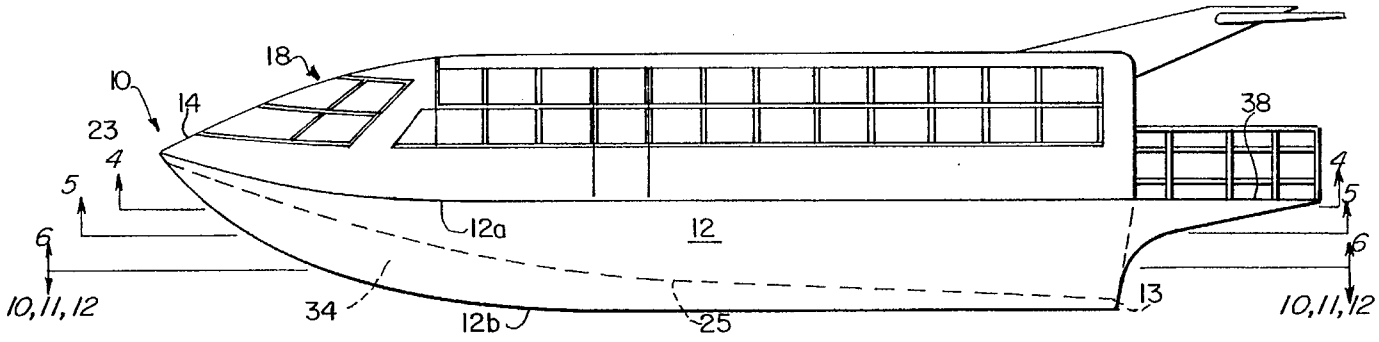
FIG. 3 is a side elevation of the hull, including a phantom line designating the apex of the inverted "U" bottom.
Figure 4:
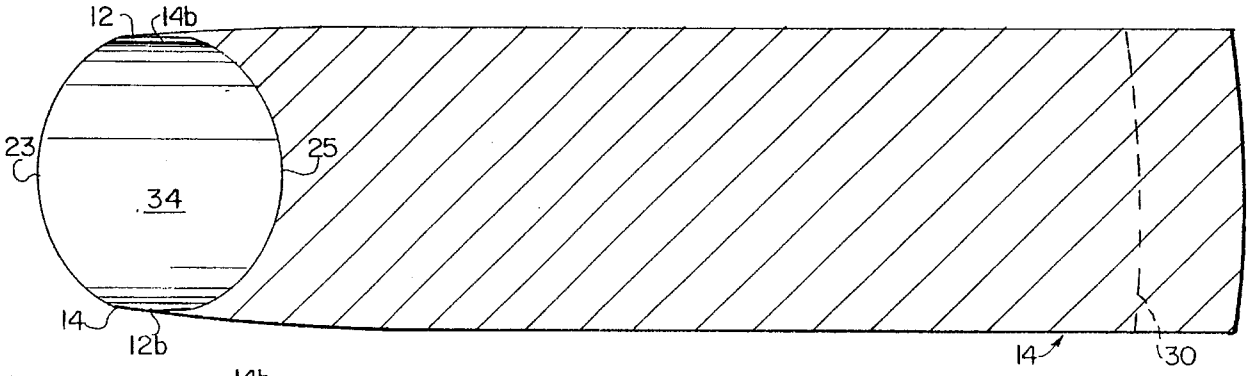
FIG. 4 is a section bottom plan view taken at line 4—4 of FIG. 3.
Figure 5:
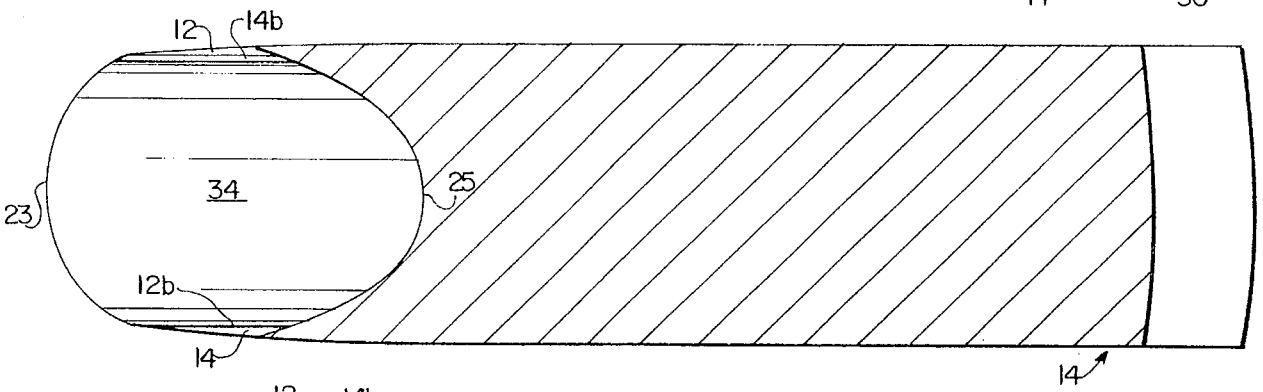
FIG. 5 is a section bottom plan view taken at line 5—5 of FIG. 3.
Figure 6:
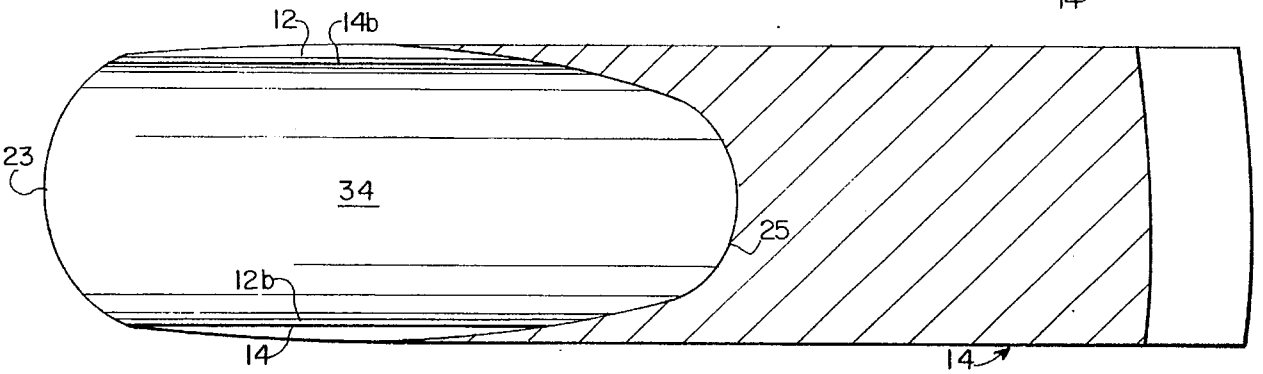
FIG. 6 is a section bottom plan view taken at line 6—6 of FIG. 3.

The stern 13 of the hull 10 may include a stern tail structure 38, shown in FIGS. 2 and 3, to facilitate loading and unloading of passengers, and carriage of cargo or boat equipment. In a preferred embodiment, the structure 38 is four (4) or six (6) feet in length.

As shown in FIGS. 1, 7, and 8 the hull 10 further includes an arcuate concave tunnel 34 running the length of the hull from bow to stern. In the drawings, the apex or apogee of the arched tunnel 34 is designated with reference numeral 25.

FIGS. 4 through 9 specifically illustrate the section profile of the tunnel 34, which tapers downwardly from bow to stern. Accordingly, from bow to stern the apogee point 25 becomes progressively closer to the chines 12*b* and 14*b*. When viewed in the plan views of FIGS. 4 through 6, the downward tapering of tunnel 34 causes the horizontal section profile of tunnel 34 to change. Specifically, in FIG. 4 the horizontal section profile of tunnel 34 is nearly circular, whereas in FIG. 5 the section profile is ovoid or semi-elliptical and in FIG. 6 the profile is elongated and oblong.

As shown in FIG. 7, the apex 25 of tunnel 34 is only slightly offset from the deck 16. The further astern, the more apex 25 is offset from the deck 16. However, as shown in FIG. 9, even at the stern transom of the hull 10, the tunnel 34 of the hull 10 is still concave, and apogee point 25 is slightly elevated above a horizontal plane connecting chines 12*b* and 14*b*.

The tunnel 34 provides a channel through which air, water, and spray are directed when the boat is in motion. Use of the tunnel 34 substantially reduces the amount of spray and water directed over the bow stem 23 of the hull 10, resulting in a smoother, less bouncy ride and preventing undesirable soaking of the deck 16 and cabin 18. Provision of the tunnel 34 also substantially eliminates pounding of the hull 10 when waves are encountered at high speed, as discussed in detail below.

As discussed above, the tunnel 34 provides a channel through which spray and water encountered by the bow are smoothly directed beneath the hull to the stern of the boat. In operation, high waves encountered by the bow of the hull 10 strike the top surface of the forward interior of tunnel 34 and are directed through tunnel 34 through the stern of the boat. After striking tunnel 34, waves are contained within tunnel 34, thereby reducing the height and intensity of the waves. Effectively, waves, spray, and air encountered by the hull 10 are compressed into a foamy cushion of air and water on which the hull 10 may travel, at the same time hydrodynamically vertically raising hull 10.

Use of the tunnel 34 also enables the hull 10 to present far less bottom surface to the water than prior art boats, thereby reducing surface friction. The only contact points between the hull 10 and the water are chines 12*b* and 14*b*, the lower vertical portions of sides 12 and 14, and the smooth lower interior sides of tunnel 34. Thus, the chines 12*b* and 14*b* tend to slice cleanly through the water, rather than bouncing over it as conventional boat hulls do. This feature permits the hull 10 to easily navigate water fouled with weed growth, driftwood, and other obstacles.

Figure 13:
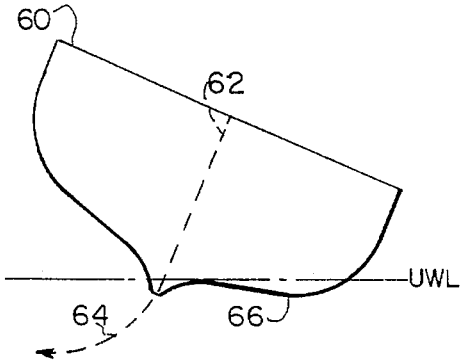
FIG. 13 PRIOR ART
FIG. 13 is an exaggerated schematic section elevation view of a prior art boat hull inclined in a sharp starboard turn showing the hull tripping along the water line.

Provision of chines 12*b* and 14*b*, sides 12 and 14 which are vertical below the at-rest water line WL and which flare outwardly above water line WL, and arcuate concave tunnel 34 also permits a hull 10 according to the present invention to substantially reduce "tripping." Prior art boats, when navigated through a sharp turn, tend to slide laterally away from the direction of the turn. FIG. 13 illustrates a conventional boat hull 61 having a keel 62 and lower hull side 66. When the hull 61 is navigated in a sharp turn, the lower hull 66 assumes a position nearly parallel to water line WL. Consequently, centrifugal force tends to slide lower hull 66 laterally along the water surface in a direction indicated by arrow 64. Such lateral sliding or "tripping" reduces the stability of a conventional hull 61, which can easily capsize if the turn angle is sharp enough.

Figure 14:
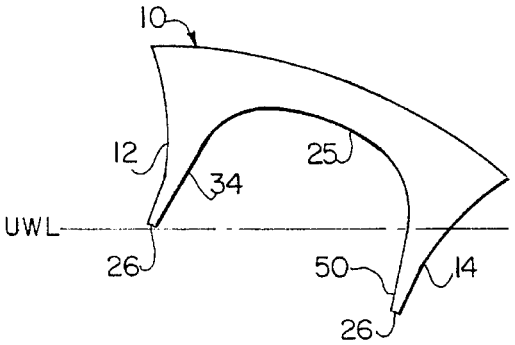
FIG. 14 is an exaggerated section elevation view of a tunneled boat hull according to the present invention, showing the hull inclined in a sharp starboard turn.

In contrast, the present invention substantially reduces "tripping" in three distinct ways. FIG. 14 illustrates an exaggerated example of boat hull 10 according to the present invention having steeply outwardly curved hull sides 12 and 14 and an arcuate concave tunnel 34 having apex point 25. When the hull 10 is navigated in a sharp starboard turn, as shown in FIG. 14, hull side 12 remains nearly vertical with respect to the under-way water line UWL, due to its curvature. Centrifugal force acting upon hull 10 must force the nearly vertical hull side 12 to push through the water in a direction away from the turn. However, substantial drag is generated by pushing hull side 12 against a volume of water, reducing the tendency of the hull to slide laterally.

Similarly, "tripping" is further reduced by provision of tunnel 34 shown in FIG. 14. In operation, when a hull 10 according to the present invention is navigated through a sharp turn, the lower interior surfaces 50 of tunnel 34 are laterally forced against a volume of water contained in tunnel 34. Since the lower interior surfaces 50 of tunnel 34 must displace a substantial volume of water to slide laterally, significant friction and drag are created, thus reducing the tendency of chines 12*b* and 14*b* to "trip" in a direction opposite the turn.

Further, weight distribution of a hull 10 according to the present invention reduces the "tripping" effect. In particular, when a hull 10 is navigated in a sharp turn as shown in FIG. 14, the center of gravity of the hull shifts slightly in the direction of the turn. However, because most of the hull mass is contained within the hull sides 12 and 14 over the chines 12*b* and 14*b*, the center of gravity remains generally aligned over apex point 25. This alignment prevents the hull 10 from capsizing or becoming unstable.

Figure 10:
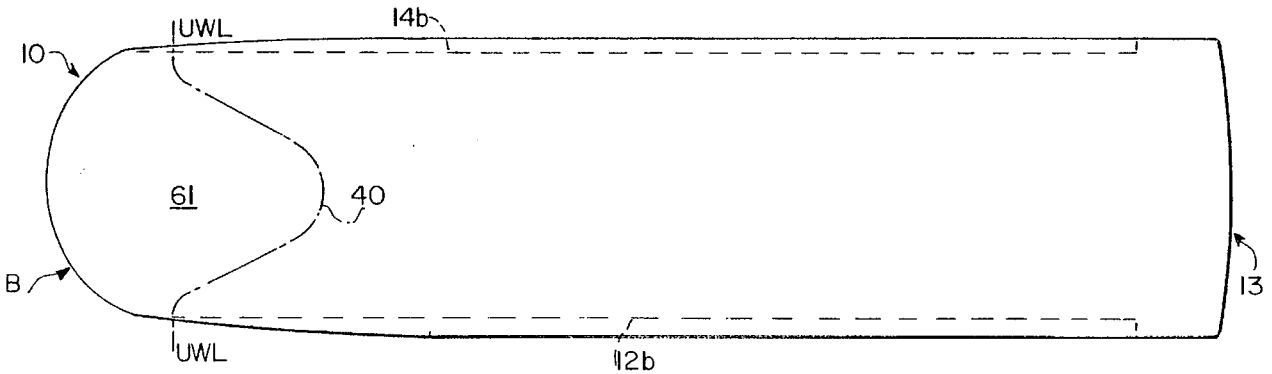
FIG. 10 is a schematic top section plan view of a boat hull according to the present invention, including a phantom line designating the hull water line when the boat hull is at rest.
Figure 11:
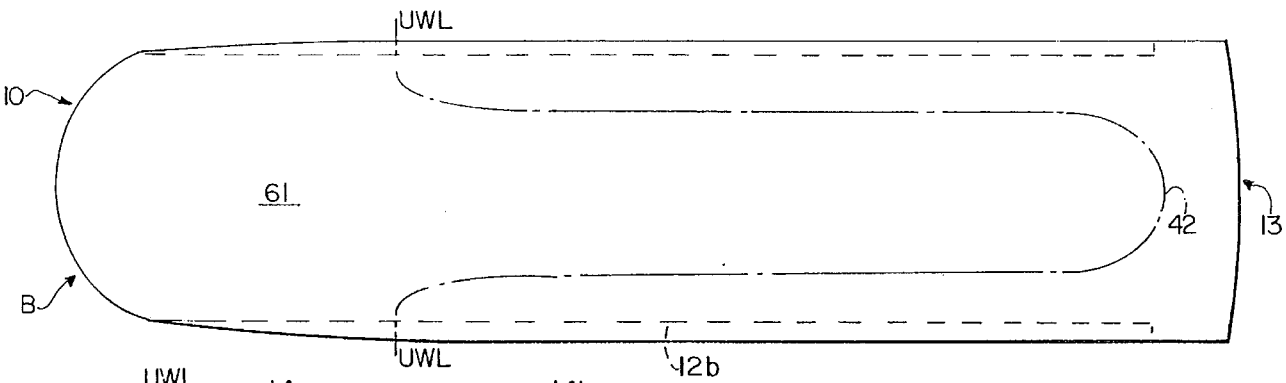
FIG. 11 is a schematic top section plan view of a boat hull according to the present invention, including a phantom line designating the hull water line when the boat hull is fully elevated in hydroplaning position.
Figure 12:
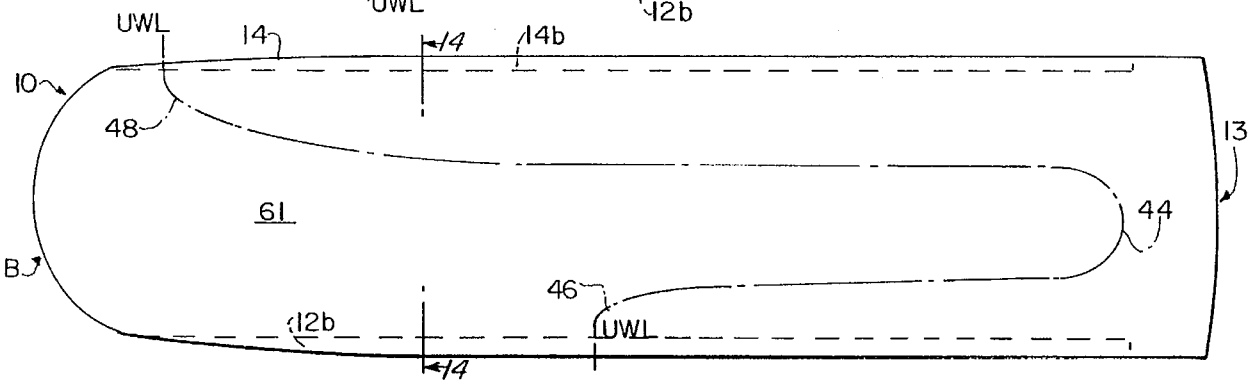
FIG. 12 is a schematic top section plan view of a boat hull according to the present invention, including a phantom line designating the hull water line existing when the hull is navigated in a sharp starboard turn.

At every stage of acceleration, turning, and hydroplaning, a hull 10 according to the present invention operates with substantially reduced friction and water contact compared to prior art hulls. FIGS. 10, 11, and 12 illustrate successive positions assumed by a hull 10 of the present invention as the hull is accelerated, achieves hydroplaning, and turns sharply. In particular, FIG. 10 depicts the hull 10 at rest, FIG. 11 shows the hull 10 in fully elevated hydroplaning position, and FIG. 12 shows the hull 10 executing a sharp turn.

In each of FIGS. 10, 11, and 12, a schematic bottom plan view of a hull 10 according to the present invention is shown. Line WL—WL represents the at-rest water line and also the point at which the hull contacts the water. Each of FIGS. 10, 11, and 12 includes a reference numeral 60 designating a portion of a hull 10 which remains dry in each of the hydroplaning positions illustrated in FIGS. 10 through 12. Thus, in each of FIGS. 10 through 12, the bow end of the hull remains dry while the stern portion is submerged up to the water line WL—WL or UWL—UWL indicated in the drawings. Further, at-rest water line WL—WL in FIG. 10 and under-way water line UWL—UWL in FIGS. 11 and 12 indicate the point at which the bottom portion of hull 10 contacts the water.

When the hull 10 is in a resting position, as illustrated in FIG. 10, water contacts the tunnel 34 and the chines 12*b* and 14*b* but does not contact the top portion of the bow B.

In contrast, FIG. 11 illustrates the position of hull 10 after acceleration to a fully elevated hydroplaning position. As shown, nearly all of tunnel 34 is raised above the water. Only chines 12*b* and 14*b* and the stern 13 of the boat contact the water along water line UWL—UWL.

FIG. 12 illustrates the position of a hull 10 when navigated in a sharp starboard turn. During such a turn, the port side chine 12*b* tends to lift higher out of the water, whereas the starboard chine 14*b* sinks deeper. Additionally, starboard side 14 is more deeply submerged than port side 12, which is partially exposed to air above the water line. Thus, the port side of tunnel 34 is also raised above the water line, contacting water only from a point 46 toward the stern of the boat. In contrast, point 48 illustrates the maximum water contact point for the starboard interior portion of tunnel 34.

When the hull 10 is navigated in a sharp port turn, the operation of the hull 10 just described for a starboard turn is reversed. Thus, during a sharp port turn, the starboard side chine 14*b* tends to lift higher out of the water, whereas the port chine 12*b* sinks deeper. Further, port side 12 is more deeply submerged than starboard side 14. The starboard side of tunnel 34 is also raised above the water line in a manner similar to that just described for the sharp starboard turn.

FIG. 14 schematically illustrates a similar arrangement occurring when the hull 10 is navigated through a sharp starboard turn. Thus, FIG. 14 schematically represents an exaggerated section view of FIG. 12 taken at line 14—14 of FIG. 12. As particularly shown in FIG. 14, a hull 10 according to the present invention generally ceases to hydroplane when navigated in a sharp turn. However, when the hull 10 is thereafter navigated out of the turn the hull 10 quickly returns to the hydroplaning position.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A keelless hydroplane boat hull including:

a bow;

a stern;

opposite, generally symmetrical port and starboard hull sides having substantially parallel port and starboard top edges and substantially parallel port and starboard chines, said sides being steeply outwardly flared above an at-rest water line to said top edges, and said sides being substantially vertical beginning at the at-rest waterline and extending below the at-rest water line to said chines, whereby when said hull is underway so as to have an underway water line and is navigated in a sharp turn, said side opposite the direction of the turn is nearly vertical with respect to the underway water line;

a deck connecting said top edges; and a continuous, arcuate, concave tunnel connecting said chines and extending the full length of said sides, said tunnel having a decreasing depth towards said stern.

2. The hull of claim 1, wherein said deck is upwardly arcuate and convex at said bow.

3. The hull of claim 1, wherein said bow is arcuate and convex at said bow in a transverse plane.

4. A keelless hydroplane boat hull including:

a bow;

a stern;

opposite, generally symmetrical port and starboard hull sides having port and starboard top edges and port and starboard chines, said sides being steeply outwardly flared above an at-rest water line to said top edges, and said sides being substantially vertical beginning at the at-rest waterline and extending below the at-rest water line to said chines, whereby when said hull is underway so as to have an underway water line and is navigated in a sharp turn, said side opposite the direction of the turn is nearly vertical with respect to the underway water line;

a deck connecting said top edges; and a continuous, arcuate, concave tunnel connecting said chines and extending the full length of said sides, said tunnel having a decreasing depth towards said stern.

5. The hull of claim 4, wherein said deck is upwardly arcuate and convex at said bow.

6. The hull of claim 4, wherein said bow is arcuate and convex at said bow in a transverse plane.

* * * * *